US005525182A

United States Patent [19]

Miller

[11] Patent Number: 5,525,182

[45] Date of Patent: Jun. 11, 1996

[54] APPARATUS AND METHOD FOR WET REMOVAL OF FLOOR TILE

[76] Inventor: Joseph P. Miller, 203 Spinnaker Way, Neptune City, N.J. 07753

[21] Appl. No.: 515,671

[22] Filed: Aug. 16, 1995

[51] Int. Cl.[6] ..... B32B 35/00

[52] U.S. Cl. ..... 156/344; 156/584; 219/472; 219/481; 219/533; 219/536; 134/17

[58] Field of Search ..... 156/344, 584; 219/202, 472, 481, 533, 535, 536; 134/17

[56] References Cited

U.S. PATENT DOCUMENTS

| | | |
|---|---|---|
| 3,400,244 | 9/1968 | Meltzer . |
| 3,619,557 | 11/1971 | McClure . |
| 3,790,429 | 2/1974 | Berger . |
| 4,221,620 | 9/1980 | Milne . |
| 4,835,363 | 5/1989 | Hoffman . |
| 4,981,548 | 1/1991 | Poll . |
| 4,983,809 | 1/1991 | Maiette et al. . |
| 5,002,629 | 3/1991 | Nakamura . |
| 5,098,506 | 3/1992 | Brown et al. . |
| 5,208,895 | 5/1993 | Hoover, Jr. et al. . |
| 5,271,234 | 12/1993 | Carter et al. ..... 134/17 X |
| 5,296,083 | 3/1994 | Petino . |
| 5,395,479 | 3/1995 | Petino . |

FOREIGN PATENT DOCUMENTS

| | | |
|---|---|---|
| 419618 | 6/1934 | United Kingdom . |

*Primary Examiner*—Mark A. Osele
*Attorney, Agent, or Firm*—Lerner, David, Littenberg, Krumholz & Mentlik

[57] ABSTRACT

An apparatus having a self contained heat source and water supply enables the wet removal of adhesively secured floor tile upon application of heat. The apparatus includes an infrared heater fed by a propane fuel tank and a water supply fed by a pressurizing water system. The method of removing floor tiles upon application of heat in a wet environment minimizes airborne asbestos dust or other contaminants. The self contained infrared heater eliminates any potential of electrical shock hazard.

30 Claims, 2 Drawing Sheets

APPARATUS AND METHOD FOR WET REMOVAL OF FLOOR TILE

BACKGROUND OF THE INVENTION

The present invention relates in general to an apparatus and method for removal of material adhered to a substrate, and more particularly, to an apparatus and method for wet removal of tile adhesively adhered to a floor using the application of heat. Still more particularly, the present invention relates to a self contained portable apparatus and method for use in removing tiles from a floor in a wet environment without connection of a heater device to an energy source or water discharge device to a water supply which are remote from the apparatus.

Environmental Protection Agency (EPA) surveys estimate that 31,000 schools and 733,000 federal and commercial buildings have asbestos containing material (ACM) present in one form or another (USEPA 1984 A, 1984 B) "Guidance for controlling Asbestos-containing Materials in Buildings" (EPA 560/5-85-024 June 1985, "Purple Book"). Asbestos containing resilient floor sheet covering and floor tiles were manufactured from 1950 to late 1985. EPA has classified this material as Non-Friable. However, the methods of removal could render this material "Friable" and therefore EPA regulations would apply to the removal of these products. In addition to federal asbestos regulations, there are various state and local regulations that apply to the removal of ACM. Typically, these state and local regulations cover the situations in which licensed asbestos abatement personnel must be used to remove ACM, notification requirements, and ACM waste disposal requirements. In 1990 the Resilient Floor Covering Institute developed and printed "Recommended Work Practices For The Removal of Resilient Floor Coverings" (RWP). Currently, nonfriable asbestos containing floor coverings may be removed in 36 states without the need for a licensed asbestos contractor or worker certification subject to certain exceptions for particular states.

The occupational asbestos standard promulgated by the United States Occupational Safety and Health Administration (OSHA) requires that employers conduct initial air monitoring within any work area where asbestos exposure may occur to determine an employee's exposure to airborne asbestos during the work operation. 29 C.F.R. S1926.58(f)(2)(i). However, an employer can claim an exemption from this requirement by having historical monitoring data showing that the OSHA action level for an eight hour time weighted dosage and excursion limit were not exceeded during workplace operations that closely resemble the conditions of the current operation.

In 1990, Environ Corporation performed monitoring studies of asbestos exposures during the removal of asbestos-containing resilient floor tile following the RWPs and using 240 volt electric infrared machines supplied by UAS Automation Systems, Inc. (Orlando, Fla. (ATR Model 910) and by Fall Engineering Inc. (Avon, Conn.) (Tilelift Model 24×24). The asbestos exposures in these studies were well below applicable OSHA asbestos exposure limits. OSHA has reviewed these studies and concluded that the data in these reports can be relied upon as historical data in lieu of initial monitoring provided the prevailing conditions in the employer's current operation closely resemble those upon which the studies were based. Thus, an employer can rely on this data as the basis for claiming an exemption from initial monitoring requirements under the OSHA asbestos standard when removing resilient floor covering material in accordance with the RWP.

The procedures set forth in the RWP require a wet removal process wherein the ACM is heated to a sufficient temperature to facilitate removal of the tile, and particularly, to soften the adhesive adhering the tile to the floor. Prior to removal, the floor is covered with water which reduces exposure of the operator to asbestos dust which may be generated, particularly, when the tiles become broken.

Because of the occupational hazard of operator usage of high voltage electric infrared heating machines in a wet environment, OSHA has exempted the use of water during ACM removal. In those cases where dry removal is proposed, state and local regulations require that the room containing the ACM to be removed be sealed to control emanation of airborne asbestos dust and other hazardous contaminants. The high cost of sealing the work environment has made the dry removal process costly and therefore impractical.

In Poll, U.S. Pat. No. 4,981,548, there is known an apparatus for use in the heat removal of tile from a floor. The apparatus is constructed from a wheel supported frame to which there is attached an infrared heater fed by a propane tank. Notwithstanding the elimination of the electrical hazard from high voltage electric infrared heaters, the known apparatus of Poll is operated in a dry removal process. In accordance with state and local laws, this mandates the sealing of the work environment along with its additional costs.

SUMMARY OF THE INVENTION

It is broadly an object of the present invention to provide a self contained portable apparatus and method for wet removal of tile from a floor using heat which is in compliance with federal, state and local laws and regulations.

Another object of the present invention is to provide an apparatus for wet removal of tile from a floor which has a self contained infrared heating device and water discharge device which are operative without connection to an energy supply or water supply which is remote from the apparatus.

Another object of the present invention is to provide an apparatus and method for wet removal of tile from a floor using infrared heat in which no OSHA exemption for water use is required.

Another object of the present invention is to provide an apparatus for wet removal of tile from a floor using heat and water, which apparatus is totally portable and self contained.

In accordance with one embodiment of the present invention there is described an apparatus for the wet removal of material adhered to a substrate using the application of heat, the apparatus comprising a frame movable over the substrate to which the material to be removed is adhered, self contained heater means mounted on the frame for heating the material to a sufficient temperature to enable removal from the substrate, and liquid supply means mounted on the frame for supplying liquid to the material to be removed from the substrate.

In accordance with another embodiment of the present invention there is described an apparatus for the wet removal of tile from a floor using the application of heat, the apparatus comprising a frame moveable over the floor to which the tiles to be removed are adhered, a heater device mounted on the frame for heating the tiles to a sufficient temperature to enable removal from the floor, a fuel tank mounted on the frame for storing fuel for the heater device, a water discharge device mounted on the frame for discharging water onto the tiles to be removed, and a water tank mounted on the frame for storing water to be supplied to the discharge device, whereby the apparatus may be moved about the floor for use in removing tiles therefrom in a wet environment without connection of the heater device to an energy supply and the water discharge device to a water supply remote from the frame.

In accordance with another embodiment of the present invention there is described a self contained apparatus for the wet removal of tiles adhered to a floor using the application of infrared heat, the apparatus comprising a frame moveable over the floor to which the tiles to be removed are adhered; a self contained infrared heating system mounted on the frame, the heating system comprising at least one infrared heater and a fuel tank for storing fuel for operation of the heater; an adjustable mounting device positioned on the frame to enable controlling the distance from the heater to the tiles to be removed; and a self contained water discharge system mounted on the frame for discharging water onto the tiles to be removed, the water discharge system comprising a manifold having at least one nozzle for discharging water therefrom, a water tank for storing water to be supplied to the manifold, and a pressure device for maintaining the pressure of the water within a predetermined range to enable discharge of water from the nozzle, whereby the apparatus may be moved about the floor for use in removing tiles therefrom in a wet environment without connection of the heater to an energy supply and the water discharge device to a water supply remote from the frame.

In accordance with another embodiment of the present invention there is described a method for the wet removal of material adhered to a substrate using the application of heat, the method comprising moving a self contained heater mounted on a frame over the substrate to which the material to be removed is adhered, heating the material using the heater to a sufficient temperature to enable removal from the substrate, supplying liquid from a source thereof mounted on the frame to the material to be removed from the substrate, and removing the material from the substrate.

In accordance with another embodiment of the present invention there is described a method for the wet removal of tile from a floor using the application of heat, the method comprising moving a heater device mounted on a frame over the floor to which the tiles to be removed are adhered, supplying fuel from a fuel tank mounted on the frame to the heater device, heating the tiles by the heater device to a sufficient temperature to enable removal from the floor, discharging water from a water tank mounted on the frame onto the tiles to be removed, and removing the tiles from the substrate in a wet environment without connection of the heater device to an energy supply and the water tank to a water supply remote from the frame.

BRIEF DESCRIPTION OF THE DRAWINGS

The above description, as well as further objects, features and advantages of the present invention will be more fully understood with reference to the following detailed description of an apparatus and method for wet removal of tile from a floor, when taken in conjunction with the accompanying drawings, wherein.

DETAILED DESCRIPTION OF THE PREFERRED EMBODIMENTS

Figure 1:
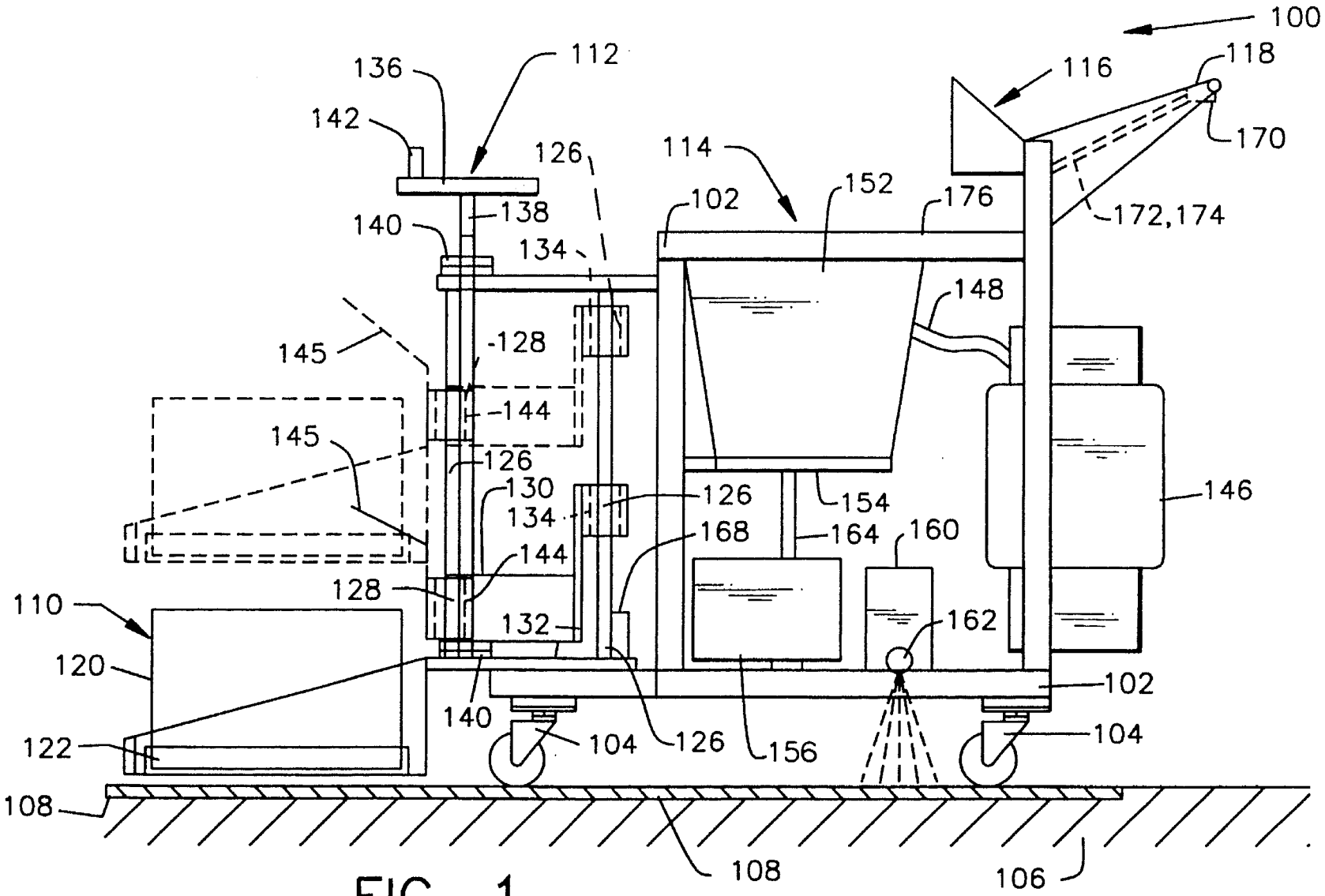
FIG. 1 is a diagrammatic side elevational view of an apparatus for wet removal of tile from a floor using heat constructed in accordance with one embodiment of the present invention.

Referring now to the drawings, wherein like reference numerals represent like elements, there is illustrated in FIG. 1 a self contained portable apparatus operative for the wet removal of tile from a floor, which apparatus has been designated generally by reference numeral 100. The apparatus 100 is constructed to include a frame 102 to which there is mounted a plurality of wheel assemblies 104 which enable movement of the apparatus over a floor 106 to which there is adhered tiles 108 to be removed. The apparatus generally includes a heater assembly 110, an adjustable heater mounting assembly 112, a liquid supply assembly 114, and a control panel 116. Each of the heater assembly 110, adjustable heater mounting assembly 112, liquid supply assembly 114 and control panel 116 are mounted to the frame 102 so as to provide a self contained portable apparatus 100. A handle assembly 118 attached to one end of the frame 102 enables manipulation of the apparatus 100 by an operator over the floor 106 having the tiles 108 to be removed. For ease of convenience, the frame 102 is sized to fit the apparatus 100 through standard doorways. By way of example, the apparatus is approximately 63.5 inches in length, 32 inches in width, and 39.5 inches in height. The weight of the apparatus is approximately 250 lbs.

Figure 2:
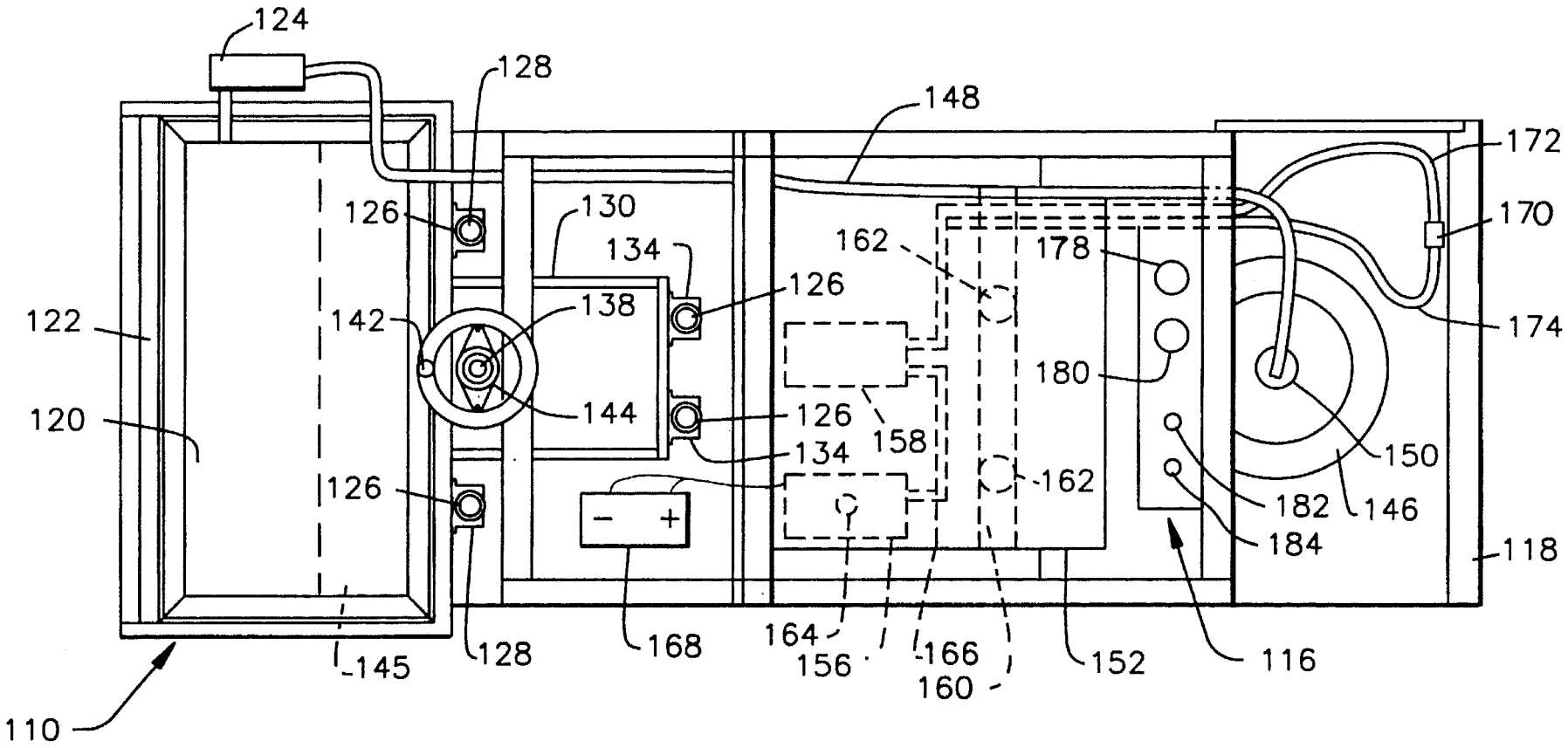
FIG. 2 is a top plan view of the apparatus for wet removal of tile from a floor constructed in accordance with one embodiment of the present invention.

Referring to FIGS. 1 and 2, the heater assembly 110 is constructed to include at least one infrared heater 120 supported by a heater support frame 122, and a gas valve/pilot light assembly 124. The gas valve/pilot light assembly 124 may include manual and solid state spark ignition, as well as continuous or intermittent pilots. The infrared heater 120 and gas valve/pilot light assembly 124 are commercially available, for example, from Enerco Technical Products, Inc. of Cleveland, Ohio. One suitable infrared heater 120 is the Enerco 400 Series Heater, having a propane rating of 30,000 Btu/hr. The infrared heater 120 can attain a temperature of approximately 1000° F.

An infrared heater 120 is preferred, in that such heaters will heat the tiles 108 to be removed, without heating the intervening air. The result is the instant heating of the tiles 108, for example, within 30 seconds of heat application. In this regard, the electro-magnetic energy released by the combustion is converted to heat only when the infrared radiation is absorbed by solid objects in its path, such as the tiles 108. It is, to be understood, that other non-electric heater assemblies 110 other than an infrared heater 120 may be employed with the present invention, such as conventional heaters which may be fed by propane or other suitable fuels so as to be self contained within the apparatus 100.

The heater assembly 110 is attached to the frame 102 by means of the adjustable heater mounting assembly 112. The heater mounting assembly 112 enables adjusting the position of the infrared heater 120 with respect to the surface of the tiles 108 to be heated. The heater mounting assembly 112 is constructed to include four vertical guide rods 126 attached to the end of the frame 102 adjacent the heater assembly 110. Two of the guide rods 126 are arranged immediately adjacent the heater assembly 110, the remaining two guide rods being positioned inwardly thereof.

As shown in FIG. 2, the guide rods 126 positioned adjacent the heater assembly 110 are spaced apart a greater distance than the guide rods arranged inwardly thereof. A pair of bushings 128 are attached spaced apart to the heater support frame 122 so as to be slidingly received along the adjacent guide rods 126. As a result of this arrangement, the heater assembly 110 is movable in a vertical direction along the guide rods 126. A support frame 130 is attached to the heater support frame 122 extending between the guide rods 126 adjacent the heater assembly 110. The support frame 130 is provided with an upstanding rear wall 132 adjacent the remaining guide rods 126. A pair of bushings 134 are attached spaced apart to the rear wall 132 so as to be slidingly received along the adjacent guide rods 126. The four guide rods 126 and bushings 128, 134 provide stable vertical movement of the heater assembly 110 as the heater assembly is raised and lowered therealong.

The raising and lowering of the heater assembly 110 is operator controlled by a crank mechanism 136. The crank mechanism 136 is constructed to include a vertical threaded rod 138 rotationally supported on the frame 102 between a pair of bearings 140. The threaded rod 138 may be rotated by means of an operator using crank handle 142 attached to the upper end of the rod. The support frame 130 is operatively coupled to the threaded rod 138 by means of an internally threaded bearing 144.

Operation of the adjustable heater mounting assembly 112 is effected by rotation of crank handle 142 by means of an operator. As the threaded rod 138 is rotated, the threaded meshed engagement between the internally threaded bearing 144 and threaded rod will cause the heater assembly 110 to be raised and lowered as supported by the guide rods 126 and bushings 128, 134. The heater assembly 110 may therefore be raised and lowered as required by the particular application of the apparatus 100 in an easy and simple manner by the operator merely rotating the crank handle 142. In this regard, it is to be understood that the adjustable heater mounting assembly 112 as thus far described, is only one example of an assembly which is operative for raising and lowering the heater assembly 110. Other arrangements using other mechanisms as known in the mechanical art for raising and lowering an object may be employed in accordance with the apparatus 100 of the present invention.

To prevent possible damage to the adjustable heater mounting assembly 112 from infrared energy being generated by the infrared heater 120, a heat shield 145 may optionally be arranged at an angle attached to the heater support frame 122 overlying one end of the infrared heater 120.

The infrared heater 120 is supplied by propane gas from a supply tank 146 through feed line 148 which is connected to the gas valve/pilot light assembly 124. The supply tank 146, which is removably mounted to one end of the frame 102, is a conventional propane tank such as those used in connection with home barbecues and the like. The feed line 148 is connected to the supply tank 146 by means of a valve 150. The apparatus 100 will accommodate a supply tank 146 of either twenty pounds or thirty pounds supply. A twenty pound tank is sufficient for heating approximately 3,000 sq. ft. of tiles 108.

The liquid supply assembly 114 is mounted on the frame 102 generally between the supply tank 146 and adjustable heater mounting assembly 112. The liquid supply assembly 114 includes a water supply tank 152 mounted to the frame 102 and supported by an underlying support 154. By way of example, the water supply tank 152 will have sufficient capacity for eleven gallons of water which is sufficient for wetting down approximately 1,500 to 2,000 sq. ft. of tiles 108. The liquid supply assembly 114 generally further includes pressurizing a water pump 156, accumulator 158, a manifold 160, and at least one spray nozzle 162 connected to the manifold and downwardly directed. Water under pressure from the supply tank 152 is fed to the pressurizing water pump 156 by means of feed line 164. Water is supplied to the accumulator 158 through feed line 166. The pressurizing water pump 156 is intermittently operated by a battery 168 mounted onto the frame 102. A water pressure regulator (not shown) is operative in conjunction with the pressurizing water pump 156 for maintaining the water pressure in the accumulator 158 within a predetermined range, for example, between about 30 and 40 psi. The water pressure within the accumulator 158 is sufficient for operation of the spray nozzles 162 for discharging a fan spray of water onto the underlying tiles 108 to be removed in a wet environment. Pressurized water flow from the accumulator 158 to the manifold 160 is controlled by a trigger handle valve 170 attached to the handle assembly 118. Water from the accumulator 158 is fed to the trigger handle valve 170 by means of feed line 172 and then to the manifold 160 by means of feed line 174. The top of the frame 102 overlying the liquid supply assembly 114 may be covered by means of a plastic cover 176.

The supplying of pressurized water to the manifold 160 has been described in accordance with one embodiment of the present invention. In this regard, the arrangement of the water pump 156 and accumulator 158 for supplying pressurized water is known in potable water systems such as those found in RVs and the like. One such water pump 156 and accumulator 158 may be obtained from Shurflo of Santa Ana, Calif. It is to be understood that other assemblies for supplying pressurized water to the manifold 160 may be included in the apparatus 100 of the present invention. For example, the water in the supply tank 146 may be placed under pressure using an air tank or other suitable means thereby eliminating the water pump 156 and accumulator 158.

The control panel 116 supports a plurality of indicator gauges and switches which are operative of the apparatus 100. In particular, there is provided a water pressure gauge 178 for the accumulator 158, a propane tank level gauge 180, a water pump on/off switch 182 and a heater control on/off switch 184 for the gas valve/pilot light assembly 124.

Briefly, in operation, the apparatus 100 is particularly suitable for wet removal of tile adhered to a floor such as by means of an adhesive. After opening valve 150 on the supply tank 146 and throwing the heater control on/off switch 184 into the "on" position, the infrared heater 120 is ignited via the gas valve/pilot light assembly 124. Approximately eleven gallons of water, along with a small quantity of a surfactant is added into the supply tank 146 and the water pump on/off switch 182 is thrown to its "on" position. At this time, the water pump 156 will pressurize the accumulator 158 with water to a pressure of about 40 psi.

Once the infrared heater 120 has reached operating temperature, the apparatus 100 is positioned overlying the floor 106 having the tiles 108 to be removed. The heater assembly 110 is raised and/or lowered to the appropriate height for the type of tiles 108 to be heated using the adjustable heat mounting assembly 112. After the tiles 108 underlying the infrared heater 120 have been heated for a sufficient time to soften the tiles 108 and adhesive, for example, about thirty seconds, the apparatus 100 is moved by the operator to an adjacent location 108. The operator will spray water onto the tiles prior to heating using the trigger handle valve 170. Once the apparatus 100 passes clear of the heated wet tiles 108, they may be easily removed using a scraper or other such tool.

By means of the combination of applied heat and water, tiles 108 may be removed without the risk of airborne asbestos dust or other hazardous contaminants. Accordingly, the present invention provides a self contained portable apparatus for the wet removal of tile from a floor by application of heat. In this regard, there is no requirement for connecting the apparatus to a remote source of fuel for the heater assembly 110 or water to the spray nozzles 162. By combining a self contained heat source and water supply into a single apparatus, the apparatus of the present invention provides advantages and improvements which cannot be obtained by the known equipment previously used for removal of tiles pursuant to the recommend work practices of the Resilient Floor Covering Institute and in compliance with federal, state and local rules and regulations, as well as being in compliance with all OSHA regulations.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. An apparatus for the wet removal of material adhered to a substrate using the application of heat, said apparatus comprising a frame movable over said substrate to which said material to be removed is adhered, self contained heater means mounted on said frame for heating said material to a sufficient temperature to enable removal from said substrate, and liquid supply means mounted on said frame for supplying liquid to said material to be removed from said substrate.

2. The apparatus of claim 1, further including adjustable mounting means for mounting said heater means onto said frame whereby the distance between said heater means and said material to be removed from said substrate may be controlled by the operator of said apparatus.

3. The apparatus of claim 2, wherein said adjustable mounting means comprises a plurality of vertical guide rods mounted on said frame, coupling means for movably coupling said heater means to said guide rods for vertical movement therealong, and a crank mechanism for raising and lowering said heater means along said guide rods.

4. The apparatus of claim 1, wherein said heater means comprises at least one infrared heater.

5. The apparatus of claim 1, wherein said liquid supply means comprises a manifold having at least one downwardly directed nozzle for the discharge of liquid therefrom onto said material to be removed, and a liquid supply tank for supplying liquid to said manifold for discharge therefrom.

6. The apparatus of claim 5, wherein said liquid comprises water.

7. The apparatus of claim 5, wherein said liquid supply means further includes pressure means for maintaining said liquid within a predetermined pressure range to enable discharge of said liquid from said nozzle.

8. The apparatus of claim 7, wherein said pressure means includes a liquid pump in operative association with an accumulator tank.

9. The apparatus of claim 1, wherein said self contained heater means comprises a fuel burning heater device and a supply of fuel for the operation thereof.

10. The apparatus of claim 9, wherein said fuel comprises propane gas.

11. An apparatus for the wet removal of tile from a floor using the application of heat, said apparatus comprising a frame moveable over said floor to which said tiles to be removed are adhered, a heater device mounted on said frame for heating said tiles to a sufficient temperature to enable removal from said floor, a fuel tank mounted on said frame for storing fuel for said heater device, a water discharge device mounted on said frame for discharging water onto said tiles to be removed, and a water tank mounted on said frame for storing water to be supplied to said discharge device, whereby said apparatus may be moved about said floor for use in removing tiles therefrom in a wet environment without connection of said heater device to an energy supply and said water discharge device to a water supply remote from said frame.

12. The apparatus of claim 11, further including adjustable mounting means for mounting said heater device onto said frame whereby the distance between said heater device and said tile to be removed from said floor may be controlled by the operator of said apparatus.

13. The apparatus of claim 12, wherein said adjustable mounting means comprises a plurality of vertical guide rods mounted on said frame, coupling means for movably coupling said heater device to said guide rods for vertical movement therealong, and a crank mechanism for raising and lowering said heater device along said guide rods.

14. The apparatus of claim 13, wherein said crank mechanism includes a rotatable threaded rod coupled to said coupling means by a threaded collar, and a crank for rotating said threaded rod, whereby the rotation of said threaded rod causes said heater device to be raised and lowered.

15. The apparatus of claim 11, wherein said heater device comprises at least one infrared heater.

16. The apparatus of claim 11, wherein said water discharge device comprises a manifold having at least one downwardly directed nozzle for the discharge of water therefrom onto said tile to be removed, and a water supply tank for supplying water to said manifold for discharge therefrom.

17. The apparatus of claim 16, wherein said water discharge device further includes pressure means for maintaining said water within a predetermined pressure range to enable discharge of said water from said nozzle.

18. The apparatus of claim 17, wherein said pressure means includes a water pump in operative association with an accumulator tank.

19. A self contained apparatus for the wet removal of tiles adhered to a floor using the application of infrared heat, said apparatus comprising a frame moveable over said floor to which said tiles to be removed are adhered; a self contained infrared heating system mounted on said frame, said heating system comprising at least one infrared heater and a fuel tank for storing fuel for operation of said heater; an adjustable mounting device positioned on said frame to enable controlling the distance from said heater to said tiles to be removed; and a self contained water discharge system mounted on said frame for discharging water onto said tiles to be removed, said water discharge system comprising a manifold having at least one nozzle for discharging water therefrom, a water tank for storing water to be supplied to said manifold, and a pressure device for maintaining the pressure of said water within a predetermined range to enable discharge of water from said nozzle, whereby said apparatus may be moved about said floor for use in removing tiles therefrom in a wet environment without connection of said heater to an energy supply and said water discharge device to a water supply remote from said frame.

20. The apparatus of claim 19, wherein said adjustable mounting device comprises a plurality of vertical guide rods mounted on said frame, coupling means for movably coupling said heater to said guide rods for vertical movement therealong, and a crank mechanism for raising and lowering said heater along said guide rods, said crank mechanism comprising a rotatable threaded rod coupled to said coupling means by a threaded collar, and a crank for rotating said threaded rod, whereby the rotation of said threaded rod causes said heater to be raised and lowered.

21. The apparatus of claim 19, wherein said pressure device includes a liquid pump in operative association with an accumulator tank.

22. A method for the wet removal of material adhered to a substrate using the application of heat, said method comprising moving a self contained heater mounted on a frame over said substrate to which said material to be removed is adhered, heating said material using said heater to a sufficient temperature to enable removal from said substrate, supplying liquid from a source thereof mounted on said frame to said material to be removed from said substrate, and removing said material from said substrate.

23. The method of claim 22, further including pressurizing said liquid within a predetermined range.

24. The method of claim 22, wherein said liquid comprises water.

25. The method of claim 22, further including positioning said heater a predetermined distance from said substrate.

26. The method of claim 22, wherein said self contained heater comprises an infrared heater and propane gas as a fuel therefore.

27. The method of claim 22, wherein said material is adhered to said substrate with adhesive material, said heating softening said adhesive sufficiently to enable removal of said material from said floor.

28. A method for the wet removal of tile from a floor using the application of heat, said method comprising moving a heater device mounted on a frame over said floor to which said tiles to be removed are adhered, supplying fuel from a fuel tank mounted on said frame to said heater device, heating said tiles by said heater device to a sufficient temperature to enable removal from said floor, discharging water from a water tank mounted on said frame onto said tiles to be removed, and removing said tiles from said substrate in a wet environment without connection of said heater device to an energy supply and said water tank to a water supply remote from said frame.

29. The method of claim 28, wherein said heater device comprises at least one infrared heater and said fuel tank comprises a propane gas tank.

30. The method of claim 28, further including pressurizing said water within a predetermined range to enable discharging thereof in a spray.

* * * * *